US005593121A

United States Patent [19]

Tackett

[11] Patent Number: 5,593,121

[45] Date of Patent: Jan. 14, 1997

[54] DETACHABLE TREE MOUNT FOR ARROW QUIVERS

[76] Inventor: Roy E. Tackett, 2902 Witteville Dr., Poteau, Okla. 74953

[21] Appl. No.: 498,573

[22] Filed: Jul. 6, 1995

[51] Int. Cl.[6] ..... F16L 3/08

[52] U.S. Cl. ..... 248/218.4; 124/25.5; 124/25.7; 224/916; 248/223.41; 248/224.51; 248/224.61; 248/230.8; 248/309.1

[58] Field of Search ..... 248/309.1, 316.1, 248/223.41, 224.51, 224.61, 230.8, 218.4; 224/256, 271, 272, 916; 124/25.5, 25.7

[56] References Cited

U.S. PATENT DOCUMENTS

| | | | |
|---|---|---|---|
| 1,697,833 | 1/1929 | Lane | 24/197 |
| 2,464,101 | 3/1949 | Schoenike | 224/916 |
| 3,777,734 | 12/1973 | Rose | 124/25.5 |
| 3,878,589 | 4/1975 | Schaefer | 224/272 |
| 4,073,328 | 2/1978 | Franklin . | |
| 4,156,496 | 5/1979 | Stinson | 124/25.7 |
| 4,252,101 | 2/1981 | Spitzke . | |
| 4,419,794 | 12/1983 | Horton, Jr. et al. | 224/272 |
| 4,635,611 | 1/1987 | Priebe | 124/25.7 |
| 4,704,800 | 11/1987 | Stinson | 124/25.7 X |
| 4,785,791 | 11/1988 | Sloop | 124/25.5 X |
| 4,788,961 | 12/1988 | Toth | 124/25.5 |
| 4,805,584 | 2/1989 | Stinson | 124/25.5 X |
| 4,932,576 | 6/1990 | Ashley | 224/272 |
| 4,995,372 | 2/1991 | Topel | 124/25.5 |
| 5,014,892 | 5/1991 | Copeland | 224/271 |
| 5,044,590 | 9/1991 | Carafice . | |
| 5,054,170 | 10/1991 | Otrusina | 224/272 |
| 5,076,522 | 12/1991 | Stinson . | |
| 5,114,107 | 5/1992 | Mahn et al. . | |
| 5,193,725 | 3/1993 | Rodocy | 224/916 |
| 5,265,585 | 11/1993 | Stinson . | |
| 5,375,749 | 12/1994 | Oliva | 224/271 |

*Primary Examiner*—Ramon O. Ramirez
*Assistant Examiner*—Michael J. Turgeon
*Attorney, Agent, or Firm*—Head, Johnson & Kachigian

[57] ABSTRACT

An apparatus for supporting an arrow quiver on or about a tree trunk or branch or a post. The apparatus comprising a mounting block through which a strap may be inserted. The strap having fasteners such as a pair of D-rings, which allow for attaching the apparatus to a tree trunk or branch. With the apparatus thus attached to the tree, an arrow quiver designed for mounting to a bow, may be removed from the bow and mounted unto said apparatus. The mounting block is designed to have mounting openings allowing for easy mounting of most standard arrow quivers while certain arrow quivers may require the addition of an adapter to allow mounting to the apparatus.

1 Claim, 2 Drawing Sheets

DETACHABLE TREE MOUNT FOR ARROW QUIVERS

BACKGROUND OF THE INVENTION

1. Field of the Invention

Archers need a means for carrying arrows when in the field and such means should allow for ease of transportation as well as protection of the arrows themselves, and ease of retrieval of the arrows when needed. A variety of arrow quivers have been designed which fulfill these requirements. Some quivers have been designed for mounting to the bow. Advantage of the bow mounted quiver is the ready availability and retrieval of additional arrows when a second or third attempt is required in rapid succession while shooting.

Many bow and arrow hunters actually hunt from blinds usually set up above ground in tree branches. In such situations improvement in handling and accuracy is achieved if the bow is not burdened by a quiver, yet there is a demand for immediate and ready access to additional arrows from a quiver. The best procedure would be to allow for the removal of the bow mounted quiver and remounting same to a convenient branch of the tree in the blind.

2. Prior Art

This invention describes such a device. Prior art as described in U.S. Pat. No. 5,076,522 teaches a screw mounted device, which may be threaded into a tree trunk or other threadable material and a quiver mounted into it. The disadvantage of such a device is that it requires manual mounting of the threaded device into the tree, the difficulty of which would depend on the dexterity of the hunter user, the hardness of the wood and the availability of tools. The present invention teaches a device which is simpler, easier to use and which overcomes both the need for tools and the brute strength which is often necessary in the previous art. The present invention is environmentally friendly as it does not result in any damage to the trees or posts.

SUMMARY OF THE INVENTION

The current invention provides a useful solution to the problem presented, in the form of a simple device readily carried on site by a hunter. The device consists of a one piece mount with a hole through which strap material such as cotton-webbing or nylon may be passed and which is then mounted around a tree trunk or branch and tightened in place by means of "D" rings or similar fastening.

The single piece mount is designed with a universal slot, which will accept most bow-mounted quivers without any further attachment or fasteners. Although the intent is to provide a one piece mount for most of the quivers currently available in the marketplace, certain specialized quivers may require slight adaptations or modification in the mount. The hunter or bowman requiring such could substitute the special purpose mount or carry more than one mount to meet his particular needs as further described. An adapter as further described, may be attached to a non-standard quiver, to allow for mounting to the present invention.

3*c* is a top view of said alternative pipe section mounting block.

Figure 4A:
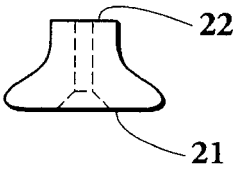

FIG. 4*a* is a top view of an adapter to be attached to a bow mounted quiver.

Figure 4B:
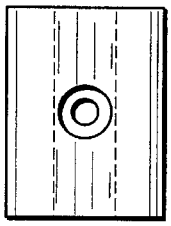

FIG. 4*b* is a front view of the adapter.

FIG, 4*c* is a side view of the adapter when attached to a quiver.

DETAILED DESCRIPTION OF THE PREFERRED EMBODIMENTS

Figure 1:
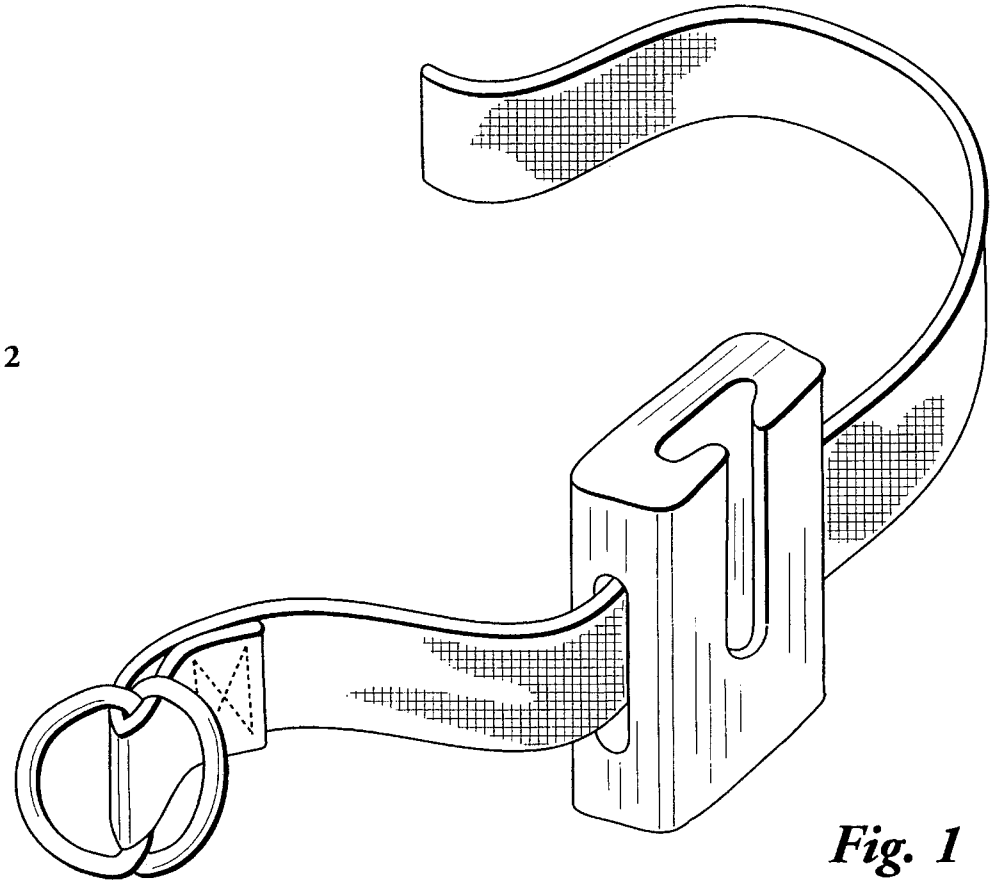
FIG. 1 is a pictorial representation of the invention.

The invention consists of a mounting block and a strap with which the mounting block may be attached to a tree trunk or branch. As shown in FIG. 1, the strap may be of cotton web material such as commonly used for belts both by hunters and in military uniforms or of nylon or other like material. The strap is also equipped with D rings which are used for securing the strap to the tree. Other fastening means such as buckles, self adhering eye and hook material or even a simple knot may also be used.

Figure 2B:
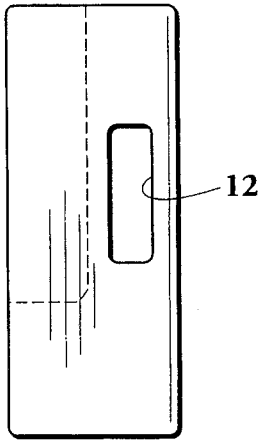
FIG. 2*b* is a side view of the mounting block.
Figure 2C:
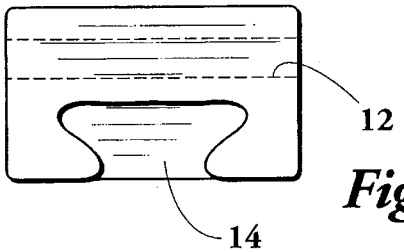
FIG. 2*c* is a top view of the mounting block.
Figure 2A:
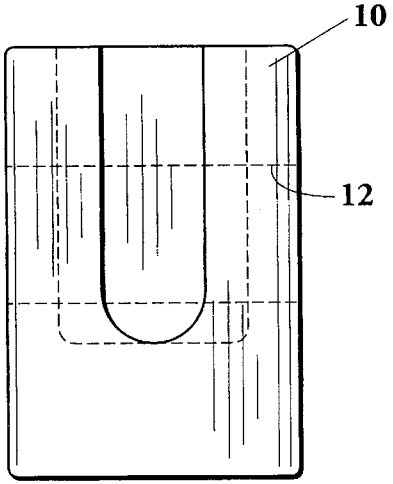
FIG. 2*a* is a front view of the mounting block.

The mounting block 10 is designed of a single piece of molded plastic, or may be fashioned out of wood or other suitable material. FIGS. 2*a*, 2*b* and 2*c* show the front, right side and top view of the mounting block when observed as normally mounted to a tree branch by the strap. In the center rear of the mounting block there is a rectangular passageway 12, through which the strap is inserted. The passageway 12, is made large enough to easily accommodate standard belt webbing or other strap material, typically 1½ inches wide. The front of the mounting block has an indent or opening 14, which extends from the top of the mounting block downwards about two thirds of the height of the mounting block. As best shown in the top view FIG. 2*c*, the indent forms a smaller outside opening and a larger inner opening. This design is such as to allow standard bow mounted quivers to be slipped into the opening 14 and secured thereby. The size of the opening is made to accommodate the standard bow mounted quivers. Specialized quivers may require oversize or undersize indent or opening 14, and such would require a modified mounting block. The construction would nevertheless be substantially the same.

The design of the one piece mounting block is economical to produce, and is lightweight and small to carry as part of the hunter's equipment.

For arrow quivers which are not equipped with a holder, an adapter may be used. The adapter may be fabricated as a small piece of molded plastic or cut from wood in the shape such that its front flat surface 21 is somewhat larger than its inner surface 22. The smaller inner surface is designed to be attached to the quiver on or near its mounting portion and when the adapter is thus mounted, the quiver assembly may be mounted on the quiver holder by slipping the adapter unto the opening 14 of the mounting block.

Figure 4C:
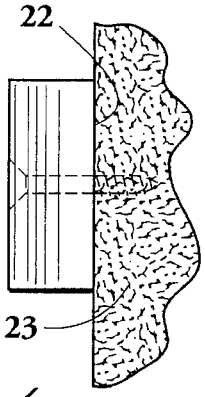

The adapter is shown in FIGS. 4*a* and 4*b* and as attached to a quiver 23 in FIG. 4*c*.

Figure 3C:
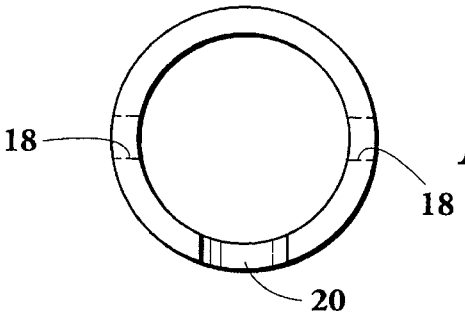
FIG. 3*a* is a front view of an alternative mounting block using a section of pipe.
FIG. 3*b* is a side view of said alternative pipe section mounting block.
Figure 3A:
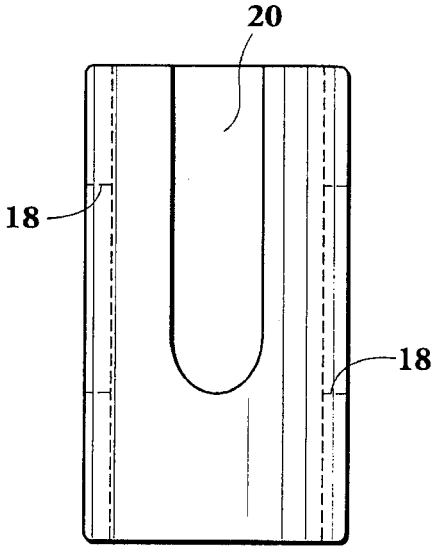
Figure 3B:
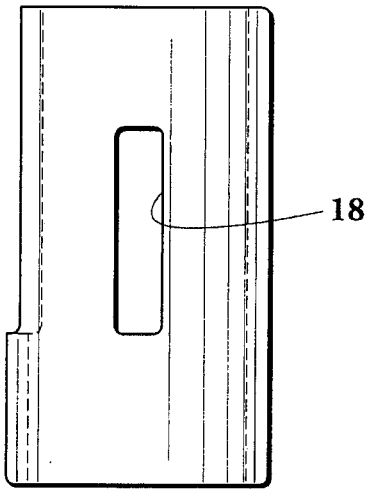

The preferred embodiment has the mounting block made of a single piece of plastic molding, however, the design may be implemented by utilizing readily available plastic pipe. FIG. 3*a* shows the front view, while FIG. 3*b* shows the side view and FIG. 3*c* shows the top view of such a mounting block. A slot 20 is cut into the front of the pipe segment mounting block, extending from the top to about two thirds of the way down. The opening is designed to be of a size to accommodate the standard bow mounted quiver. Other size opening may be designed for special quivers. A small section of such pipe about 3 inches long may be cut off. Two rectangular openings 18 for the strap are cut into opposite sides of the pipe about the center thereof. The strap is pulled through the openings 18 and when secured to a tree limb with D-rings or other fastening means, will hold the mounting block unto the tree. A quiver may then be easily mounted by sliding its mounting indent into the block opening.

Whereas, the present invention has been described in relation to the drawings attached hereto, it should be understood that other and further modifications, apart from those shown or suggested herein, may be made within the spirit and scope of this invention.

What is claimed is:

1. An apparatus for mounting bow mounted arrow quivers to a tree trunk, tree branch or post, said apparatus comprising a mounting block and a strap with means for securing said strap to said tree, trunk, tree branch or post, where said mounting block is a short section of tubular plastic pipe with two rectilinear holes cut out on opposing sides of the wall of said tubular plastic pipe through which holes said strap is inserted and an opening extending from one end of said tubular plastic pipe section extending about two thirds the length of said tubular pipe section into which the bow mounted quiver mounting means may be inserted.

* * * * *